US012797710B2

(12) United States Patent
Simpson

(10) Patent No.: US 12,797,710 B2
(45) Date of Patent: Nov. 17, 2026

(54) TABLET MOUNTING SYSTEM

(71) Applicant: The Rowing Company, Inc., Water Mill, NY (US)

(72) Inventor: Gary Simpson, Water Mill, NY (US)

(73) Assignee: THE ROWING COMPANY, INC., Water Mill, NY (US)

( * ) Notice: Subject to any disclaimer, the term of this patent is extended or adjusted under 35 U.S.C. 154(b) by 132 days.

(21) Appl. No.: 18/825,656

(22) Filed: Sep. 5, 2024

(65) Prior Publication Data

US 2025/0083022 A1 Mar. 13, 2025

Related U.S. Application Data

(60) Provisional application No. 63/537,330, filed on Sep. 8, 2023.

(51) Int. Cl.

| | |
|---|---|
| ***F16M 13/02*** | (2006.01) |
| ***A63B 22/00*** | (2006.01) |
| ***A63B 71/06*** | (2006.01) |

(52) U.S. Cl.

CPC ..... *A63B 71/0619* (2013.01); *A63B 22/0076* (2013.01); *A63B 2071/0658* (2013.01)

(58) Field of Classification Search

CPC ..... A63B 71/0619; A63B 22/0076; A63B 2071/0658; A63B 2210/50; F16M 11/04; F16M 11/041; F16M 11/10; F16M 11/2014; F16M 13/02

See application file for complete search history.

(56) References Cited

U.S. PATENT DOCUMENTS

| | | | | |
|---|---|---|---|---|
| 10,180,209 | B2 * | 1/2019 | Bowman | F16M 13/02 |
| 10,767,807 | B2 * | 9/2020 | Kulesia, II | F16M 11/42 |
| 11,311,106 | B2 | 4/2022 | Whalen et al. | |
| 11,732,839 | B2 | 8/2023 | Atakan | |
| 11,754,217 | B2 * | 9/2023 | Leman | F16M 11/08 248/442.2 |
| 2012/0056050 | A1 * | 3/2012 | Huang | F16M 11/2064 248/122.1 |
| 2018/0128309 | A1 | 5/2018 | Yonemaru | |
| 2019/0003631 | A1 | 1/2019 | Hung | |
| 2023/0109955 | A1 | 4/2023 | Gu | |

OTHER PUBLICATIONS

Notification, International Search Report, and Written Opinion mailed Dec. 12, 2024, from International Patent Application No. PCT/US2024/045341, 14 sheets.

* cited by examiner

*Primary Examiner* — Amy J. Sterling
(74) *Attorney, Agent, or Firm* — KATTEN MUCHIN ROSENMAN LLP

(57) ABSTRACT

The tablet mounting system allows a large tablet to be added to existing exercise devices while allowing the original tablet or exercise computer to remain attached. The tablet mounting system allows the tablet to articulate in at least two directions while remaining stable during use of the exercise device. The tablet mounting system also incorporate cable management to ensure wires for the tablet do not interfere with use of the exercise device.

17 Claims, 14 Drawing Sheets

TABLET MOUNTING SYSTEM

CROSS-REFERENCE TO RELATED APPLICATIONS

This application claims priority to U.S. Provisional Application Ser. No. 63/537,330, filed Sep. 8, 2023, the entire contents of which are hereby incorporated by reference in their entirety.

FIELD OF THE INVENTION

The tablet mounting system of the present invention provides a secure connection for a tablet to an exercise device. In particular, the tablet mounting system provides a rigid connection to the exercise device while also allowing for articulation of the tablet in more than one dimension.

SUMMARY

The tablet mounting system of the present invention allows a large tablet to be added to existing exercise devices while allowing the original tablet or exercise computer to remain attached. The tablet mounting system allows the tablet to articulate in at least two directions while remaining stable during use of the exercise device. The tablet mounting system also incorporate cable management to ensure wires for the tablet do not interfere with use of the exercise device.

In one or more implementations, not all of the depicted components in each FIG. may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Figure 1:
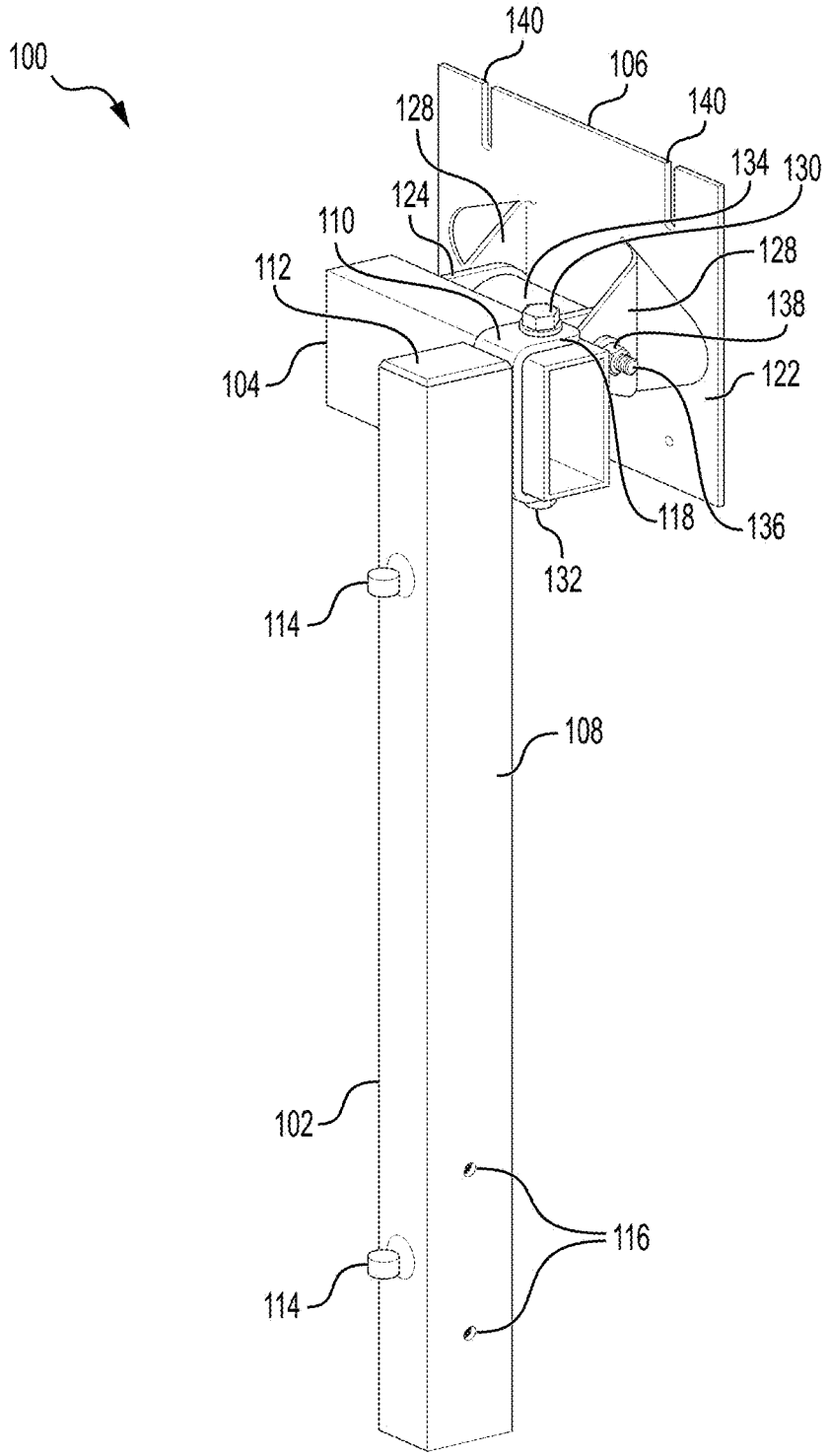
FIG. 1 depicts a perspective view of the tablet mounting system.

FIG. 1 depicts a perspective view of the tablet mounting system 100 in isolation. The tablet mounting system 100 is designed is designed to support a far larger tablet (e.g., 21.5" diagonal screen size) than the tablet mounting systems currently or previously offered for use with exercise devices, such as rowers. The tablet mounting system 100 also offers articulation of the tablet 602 in more than one dimension.

The tablet mounting system 100 rigidly couples a dedicated tablet 602 to the exercise device 502 to help mitigate vibrations and bounce experienced with currently available mounting options. The construction of the tablet mounting system 100 mount provides a large bearing area with the exercise device 502 as well as a large tilt bearing with bevel springs providing the added rigidity mentioned prior. The articulation aspect of the tablet mounting system 100 system allows the user to rotate the tablet 90° for content that may depict video in a different aspect ratio (e.g., portrait vs landscape). The tablet mounting system 100 also provides tilt articulation that allows for each user a larger range of ergonomic positions for viewing the tablet 602 both on and off the exercise device 502. The increased ergonomic benefits of the tablet mounting system 100 in turn allow users to perform workouts in greater comfort and focus leading to an overall increase in effectiveness of their workouts.

The tablet mounting system 100 generally comprises vertical mounting arm 102, a horizontal mounting arm 104, and a tablet mounting plate 106. The vertical mounting arm 102 couples the tablet mounting system 100 to the exercise device and supports the entire weight of the tablet. The vertical mounting arm 102 comprises central tube 108, horizontal arm mounting bracket 110, tube cap 112, and cable management clips 114. The central tube 108 has a plurality of mounting and clearance holes 116 extending the width of central tube 108. Bolts placed through holes 116 are used to secure the vertical mounting arm 102 to the exercise device as will be described later.

Horizontal arm mounting bracket 110 is preferably formed from a bent piece of plate steel in having an aligned pair of mounting holes 118 (e.g., a C bracket). The mounting holes 118 are parallel to each other and share a common central axis in a preferred embodiment. The horizontal arm mounting bracket 110 is preferably welded to the central tube 108 as depicted in FIG. 1. In other embodiments, the horizontal arm mounting bracket 110 can be coupled to the central tube 108 using a clamp or other fixation device at any location along its length.

Figure 2:
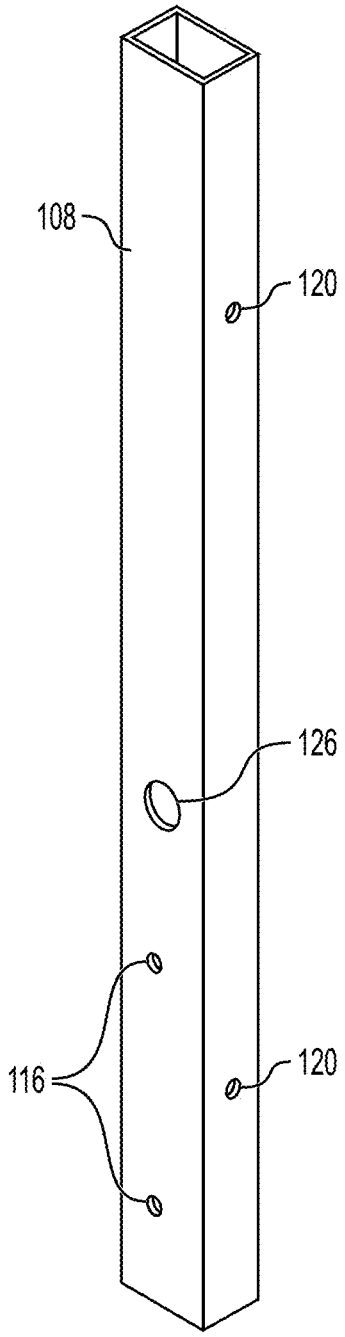
FIG. 2 depicts the vertical arm of the tablet mounting system in isolation.

The tube cap 112 seals the top of central tube 108 and can be removed to thread cables through central tube 108 as needed. As depicted in FIG. 2, the center of central tube 108 is hollow and can accommodate multiple wires.

The cable management clips 114 are inserted into a plurality of holes 120 on central tube 108 or may be formed integrally as depicted in FIG. 2. Central tube 108 may comprises an opening 126 which is sized to accommodate an end of the bolt supporting the PM5 monitor arm 508 as will be depicted later.

Figure 3A:
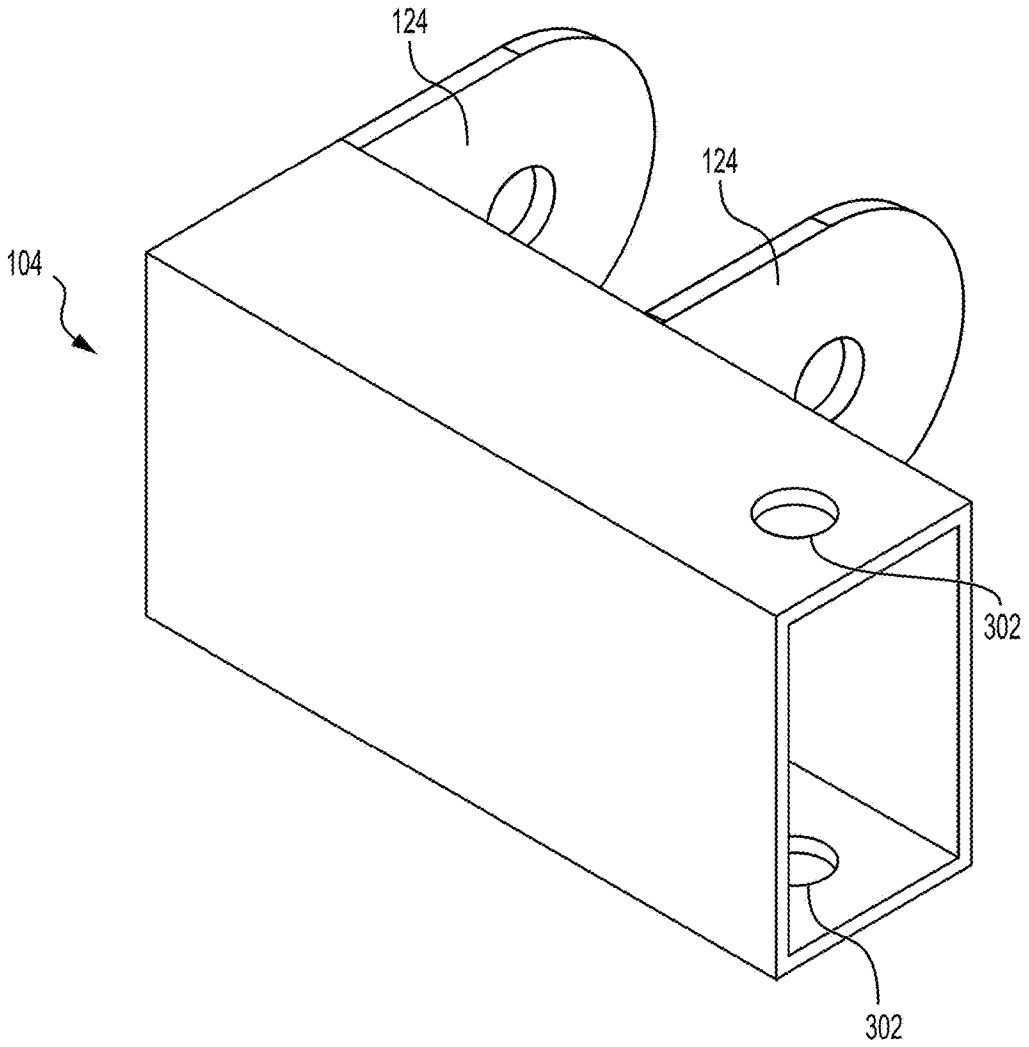
FIGS. 3A-3B depict the horizontal arm of the tablet mounting system in isolation.
Figure 3B:
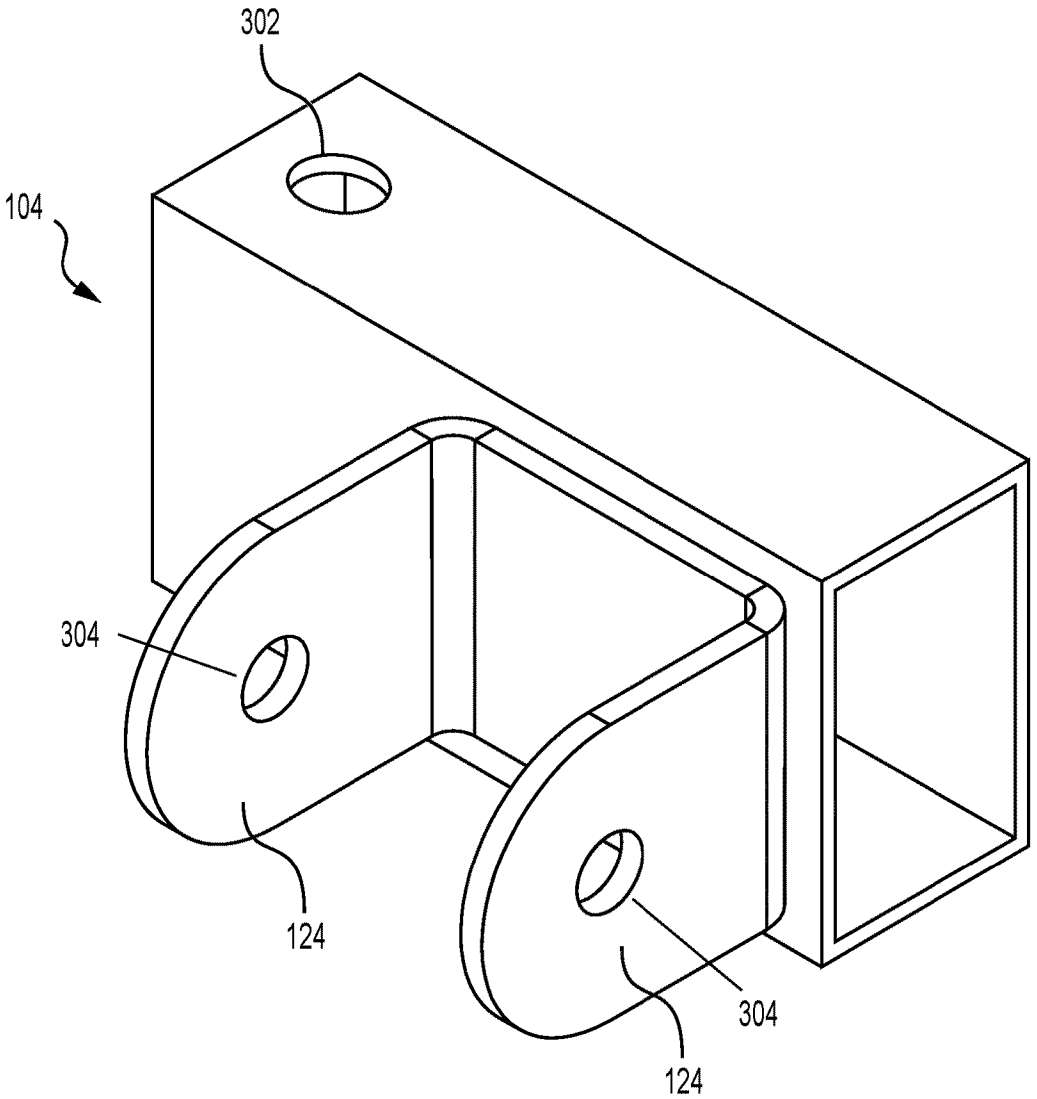

As shown in FIGS. 3A-3B, horizontal mounting arm 104 comprises an aligned pair of bolt holes 302 which align with mounting holes 118 in horizontal arm mounting bracket 110. A bolt (e.g., a ⅜" bolt secured with a nut) placed through mounting holes 118 and bolt holes 302 secures horizontal mounting arm 104 to horizontal arm mounting bracket 110 with nut 132. Horizontal mounting arm 104 further comprises a pair of aligned mounting holes 304 for securing tablet mounting plate 106 to horizontal mounting arm 104. The alignment axis of mounting holes 304 is preferably orthogonal to the alignment axis of bolt holes 302.

At an end of horizontal mounting arm 104 opposite holes 302, a first hinge extension 124 is provided that is coupled to a side of the horizontal mounting arm 104. In a preferred embodiment, first hinge extension 124 is welded to a side of horizontal mounting arm 104. As depicted in FIG. 1, second hinge extension 124 allows tablet mounting plate 106 to be coupled to tablet mounting system 100. A rear of tablet mounting plate 106 comprises hinge extension 128 that mate with hinge extension 124, allowing articulation of tablet mounting plate 106 upward and downward.

The tablet mounting plate 106 incorporates mounting plate 122 and hinge extension 128. In a preferred embodiment, mounting plate 122 incorporates a Video Electronics Standards Association (VESA) mounting standard for the size tablet being used (VESA MIS-D 100 C). The tablet mounting plate 106 is coupled to the horizontal mounting arm 104 with a bolt 136 placed through first hinge extensions 124, second hinge extensions 128, and central hinge 132, and is secured with nut 138.

The central hinge 134 allows the tablet to articulate upward and downward. The hinge comprises disc springs 402 used to support the tablet mounting plate 106 and provide the friction needed in the joint to support the tablet in a stable user set position.

Figure 4:
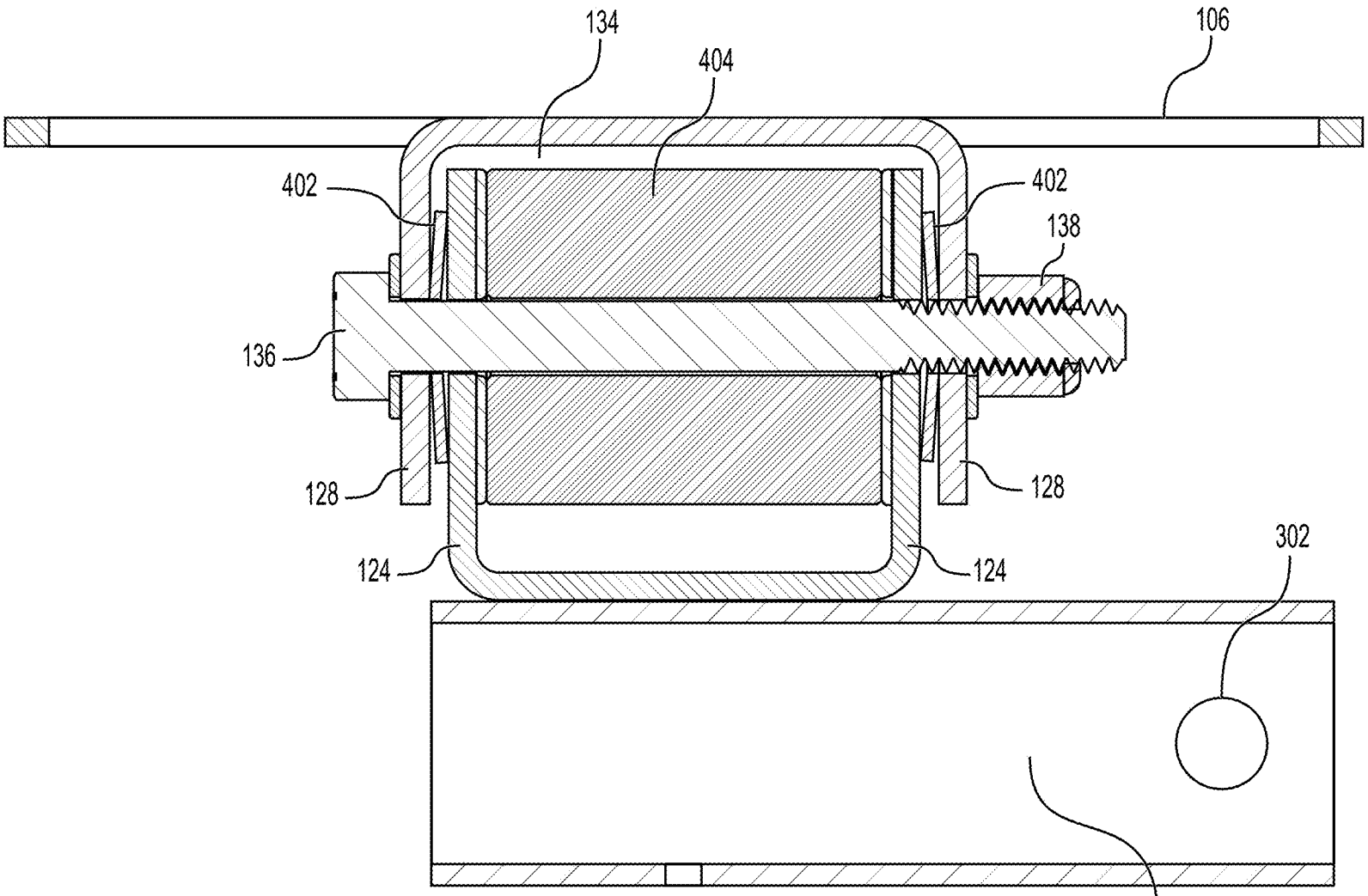
FIG. 4 depicts a cross-section of the hinge joining the horizontal mounting arm to the tablet mounting plate.

FIG. 4 is a cross-section showing the connection between first hinge extensions 124, second hinge extensions 128, and central hinge 134. The disc springs 402 (sandwiched between an inner edge of second hinge extension 128 and an outer edge of first hinge extension 124) maintain constant force in the central hinge 132 so that the tilt position is stable once the desired tilt angle is set. The large diameter of the plastic cylinder 404 provides a large bearing surface against first hinge extensions 124 and increases the stability of the central hinge 134. The short length of the horizontal mounting arm 104 is helpful with the overall stability of the tablet.

In a preferred embodiment, tablet mounting plate 106 can support tablets having a screen size ≥21.5". Mounting plate 122 comprises two slots 140 and openings 142. A bottom of slots 140 and openings 142 form a rectangle approximately the same size as a VESA mount. However, the slots 140 allow for easier installation of the table 602 as will be depicted later.

Because the tablet 602 is much larger than existing PM5 monitors 506 found on exercise devices 502, the tablet 602 can be coupled to the exercise device 502 directly so it can display the same information as the PM5 monitor 506 while also having enough other screen real estate to provide other functionality, such as displaying a real time workout program. The tablet 602 can retrieve and store performance data (e.g., rowing performance data) from the PM5 monitor 506.

Figure 5A:
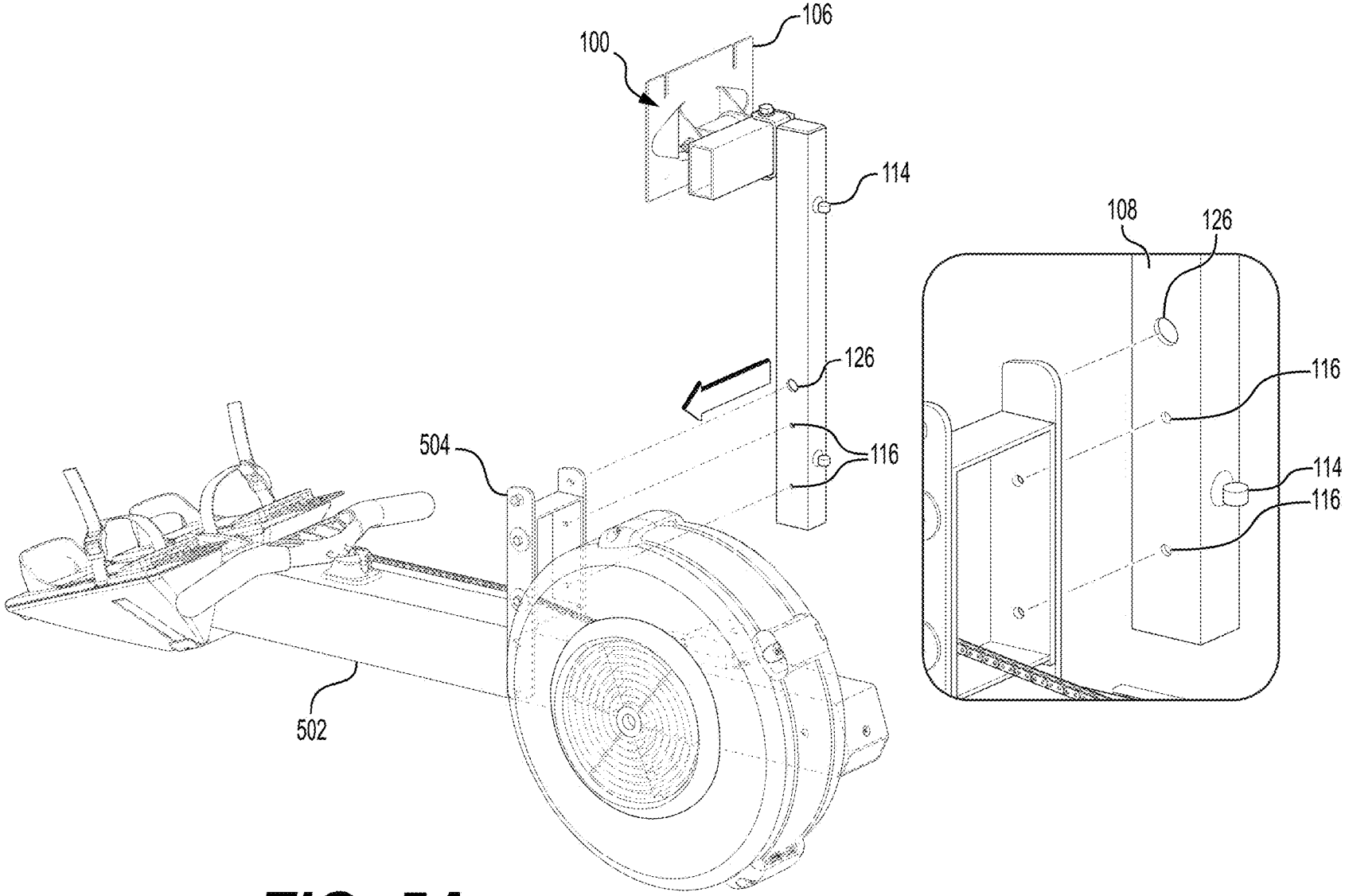
FIGS. 5A-5B depicts the coupling between the vertical mounting arm and an exercise device.
Figure 5B:
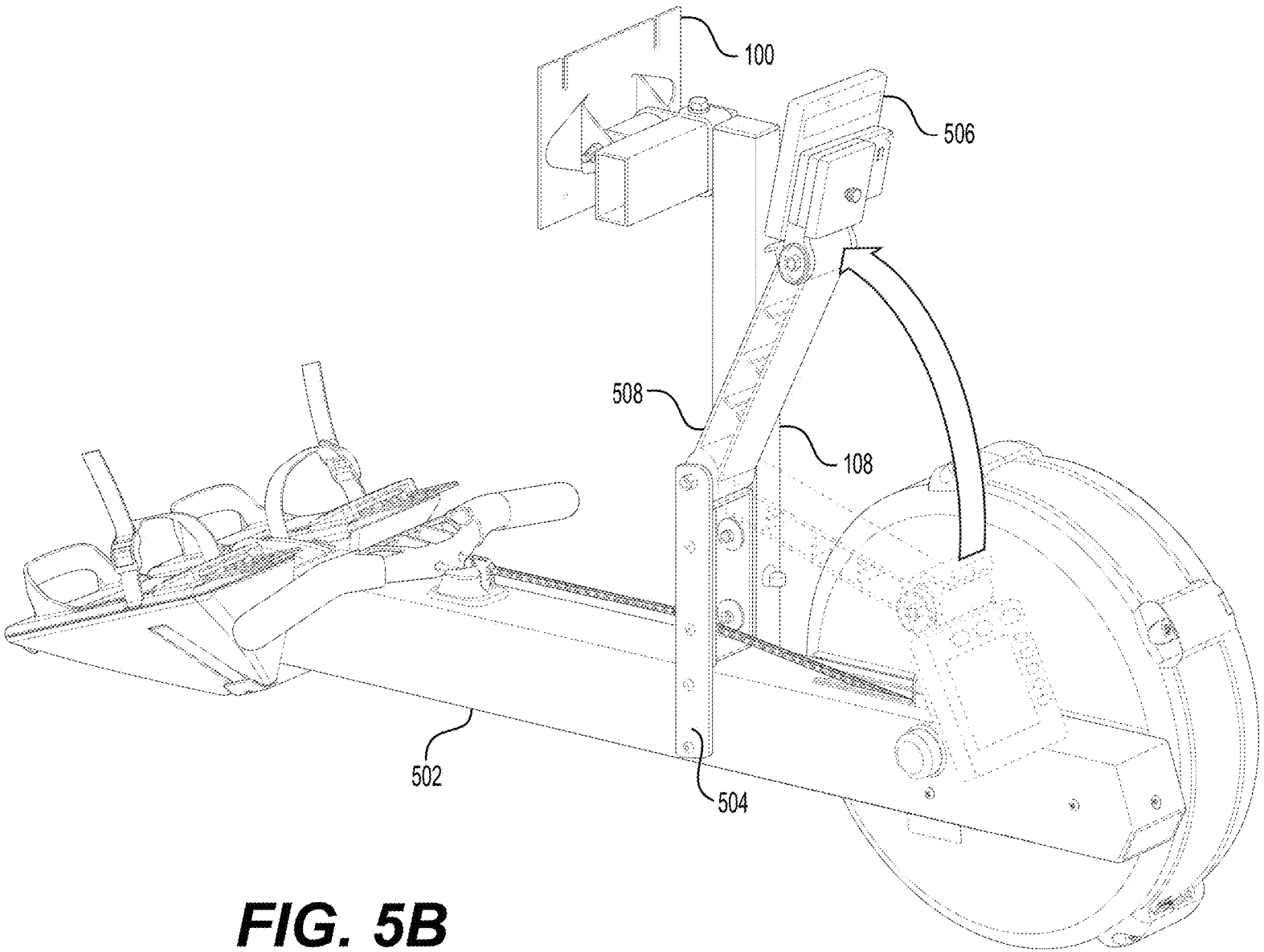

As previously described the tablet mounting system 100 can be coupled to an exercise device 502 having an existing PM5 monitor 506 already mounted to bracket 504. FIG. 5A depicts how tablet mounting system 100 can be coupled to a rower 502 and FIG. 5B depicts tablet mounting system 100 in use together with PM5 monitor 506 also mounted to bracket 504. The PM5 monitor 506 can be adjusted independently of tablet mounting system 100. In a preferred embodiment, the rower 502 is a RowErg from Concept2. Generally, many rowers 502 are provided with a PM5 monitor 506 that is coupled to rower 502 via bracket 504. The central tube 108 is coupled to bracket 504 using a bolt placed through mounting and clearance holes 116. Opening 126 provides clearance for the bolt used to couple the PM5 monitor arm 508 to bracket 504.

Figure 6A:
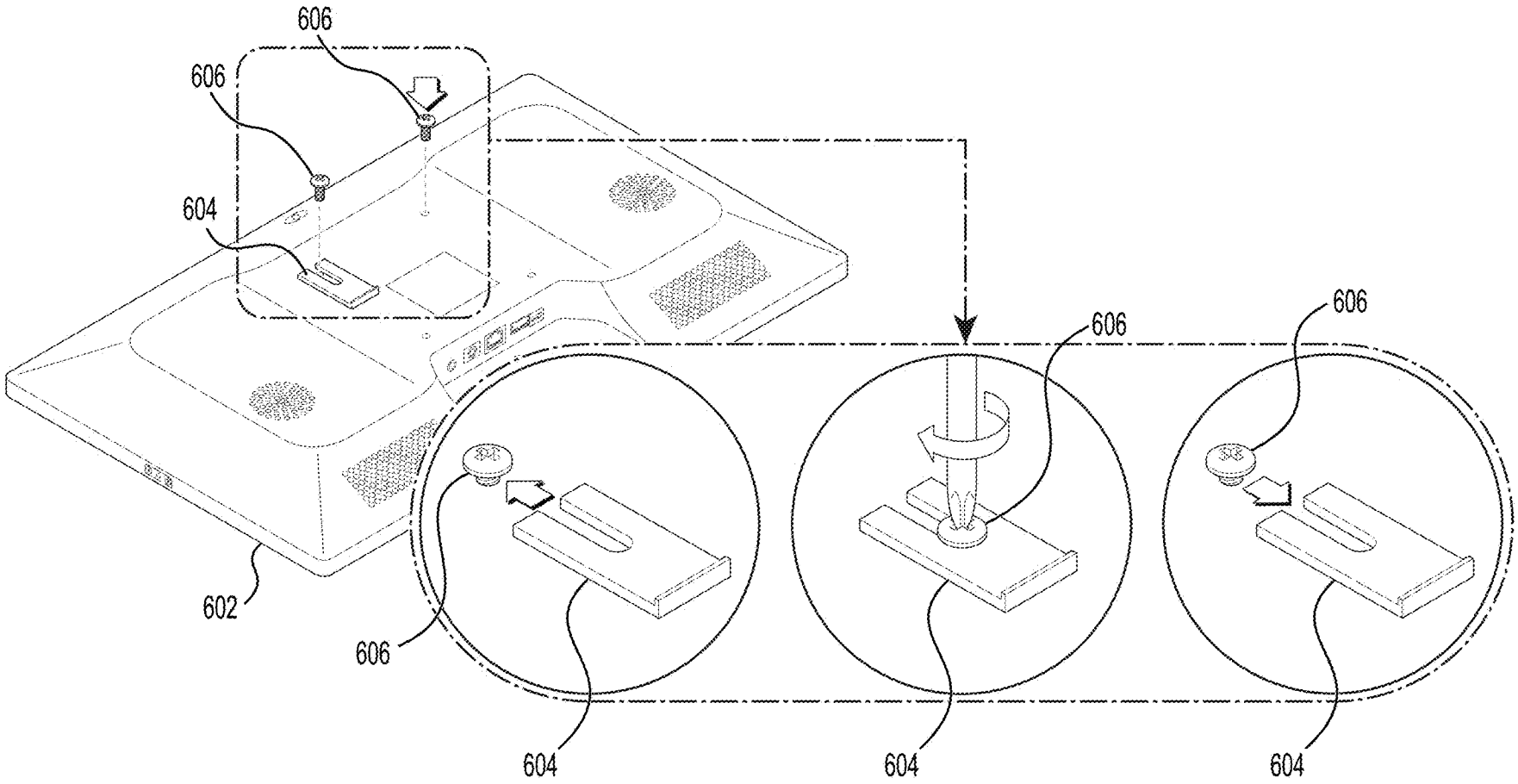
FIGS. 6A-6E depict the steps used to couple a tablet to the tablet mounting system.
Figure 6C:
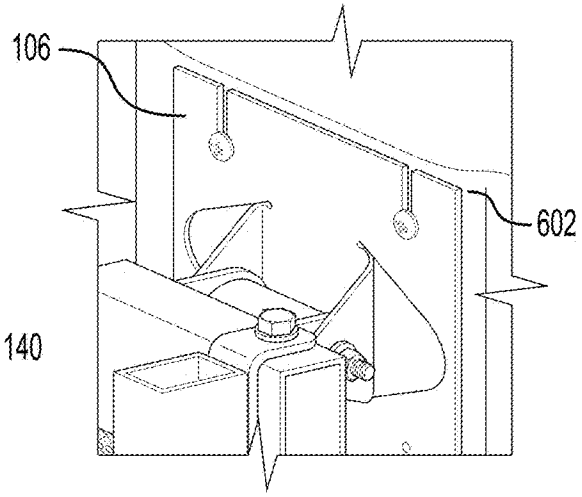
Figure 6D:
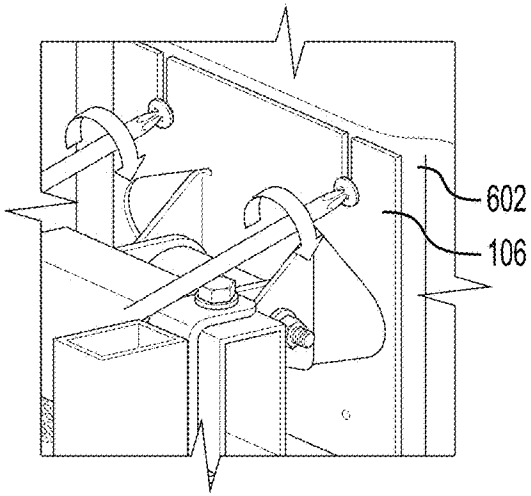
Figure 6B:
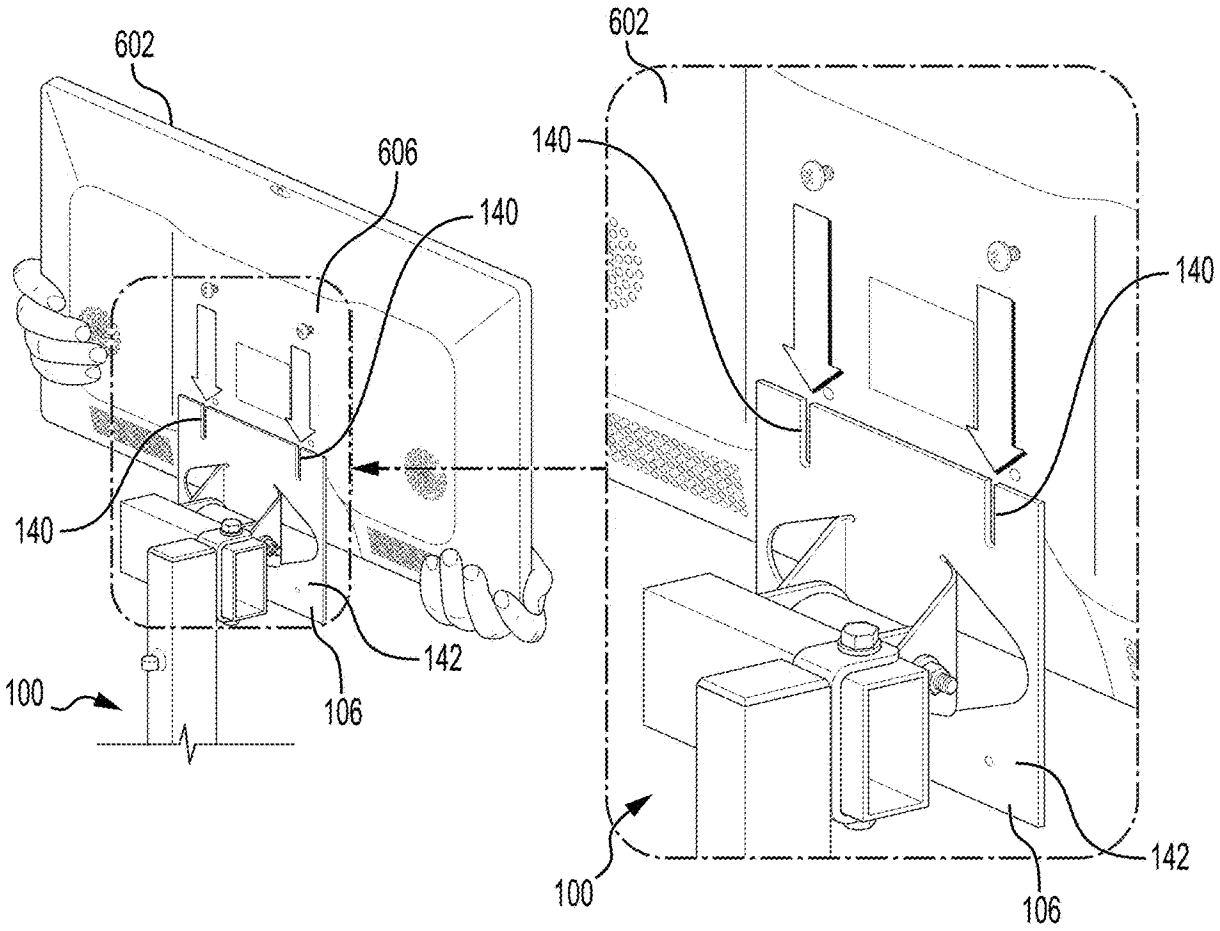
Figure 6E:
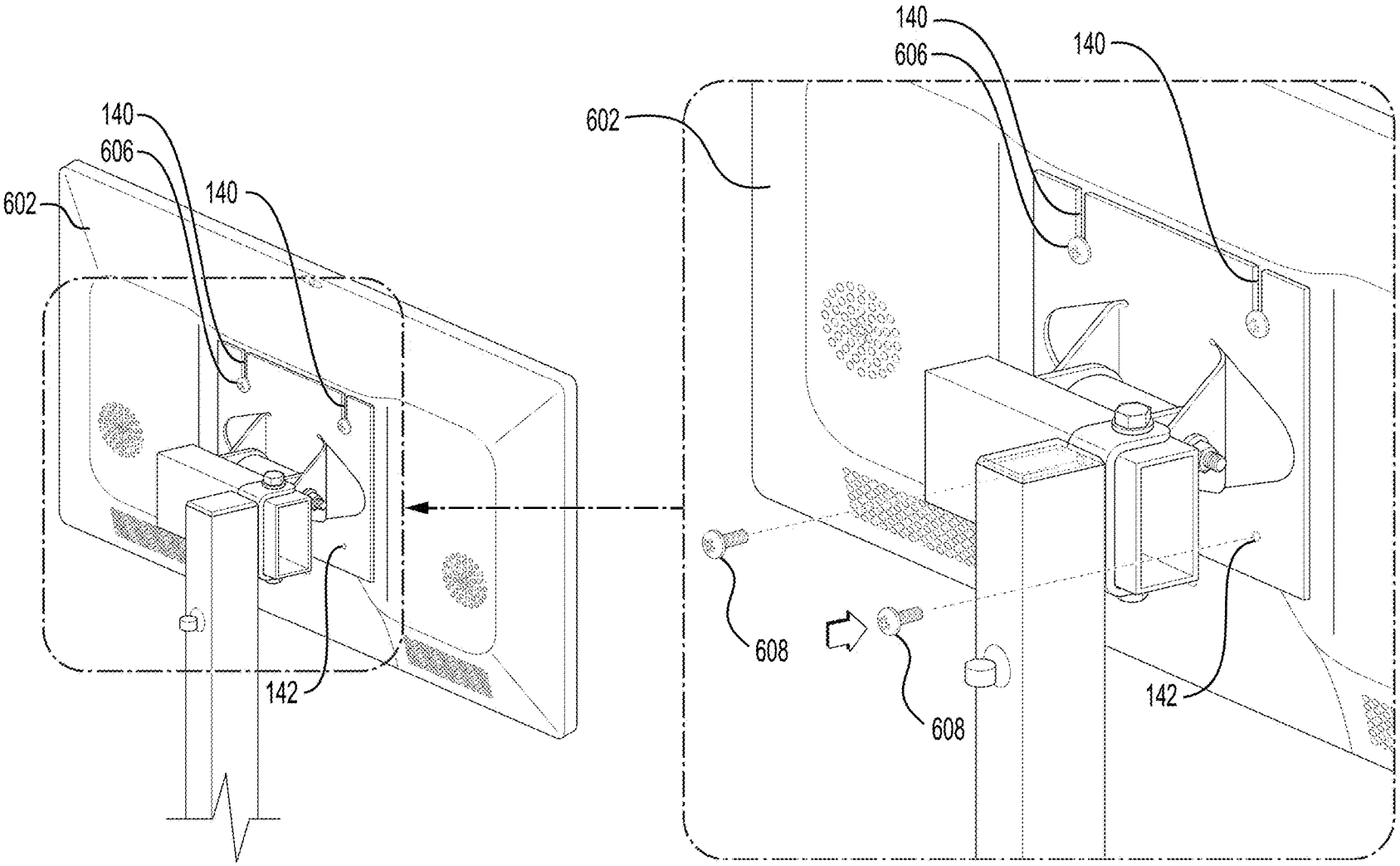

FIGS. 6A-6E depicts the steps used to couple a tablet 602 to mounting plate 122 after central tube 108 is coupled to bracket 504. As shown, the tablet 602 can be coupled directly to the tablet mounting system 100 via a plurality of screws (e.g., using the VESA standard). First, a shim 604 is used to screw in the upper two screws 606 into the VESA mounting openings on tablet 602 as depicted in FIG. 6A. Preferably, shim 605 has a thickness that is approximately the same as that of mounting plate 122 (e.g., 3/16"). Once the screws 606 have been inserted, the screws 606 can be slid into slots 140 as depicted in FIG. 6B-6C. This allows the tablet 602 to be simply slid into place, making installation easier. The screws 606 can then be tightened as needed in FIG. 6D. Finally, two lower screws 608 can be inserted through openings 142 and into the two remaining VESA mount openings on tablet 602 as depicted in FIG. 6E.

Figure 7:
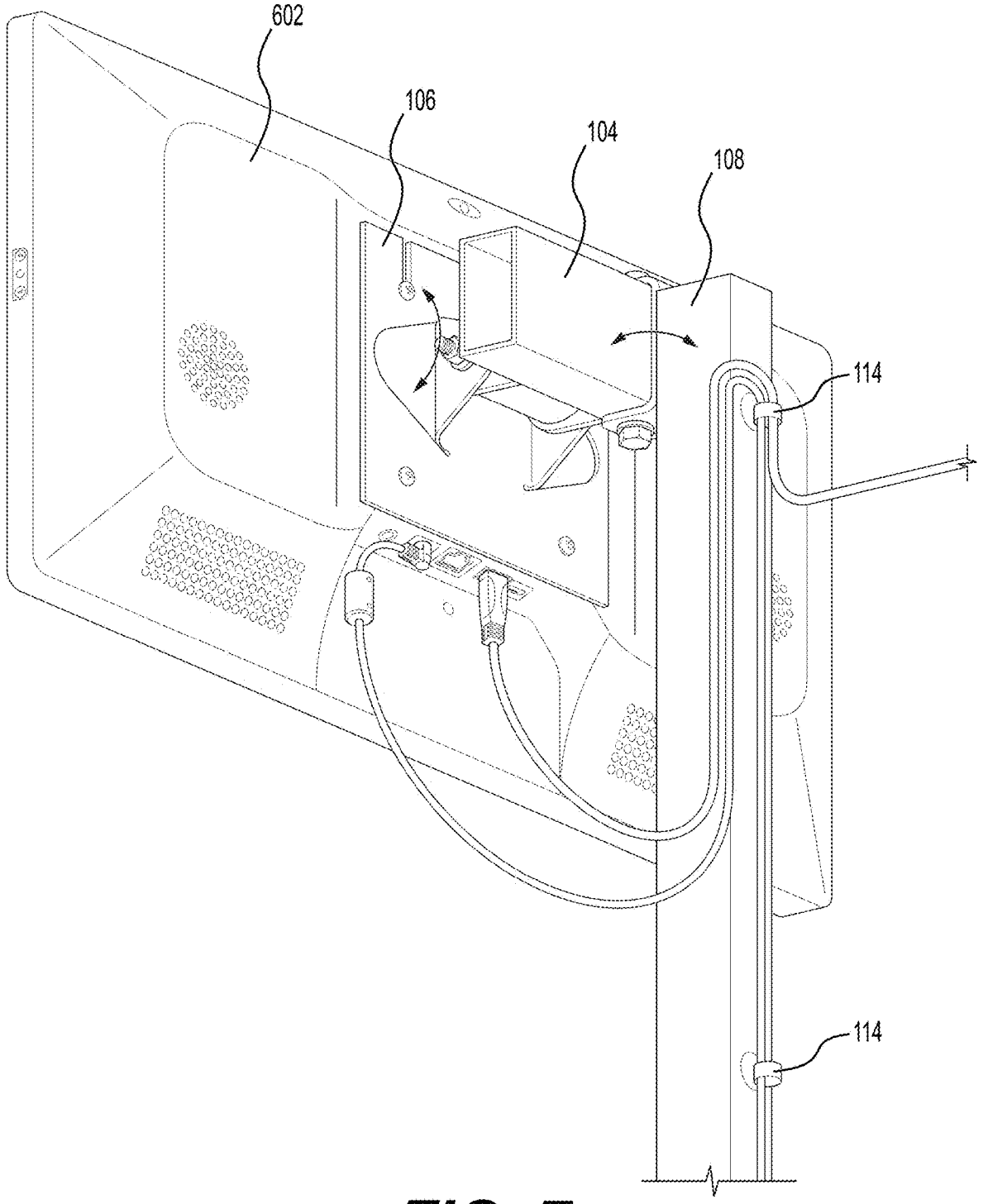
FIG. 7 depicts the use of cable management clips to manage cables from the tablet.
Figure 8:
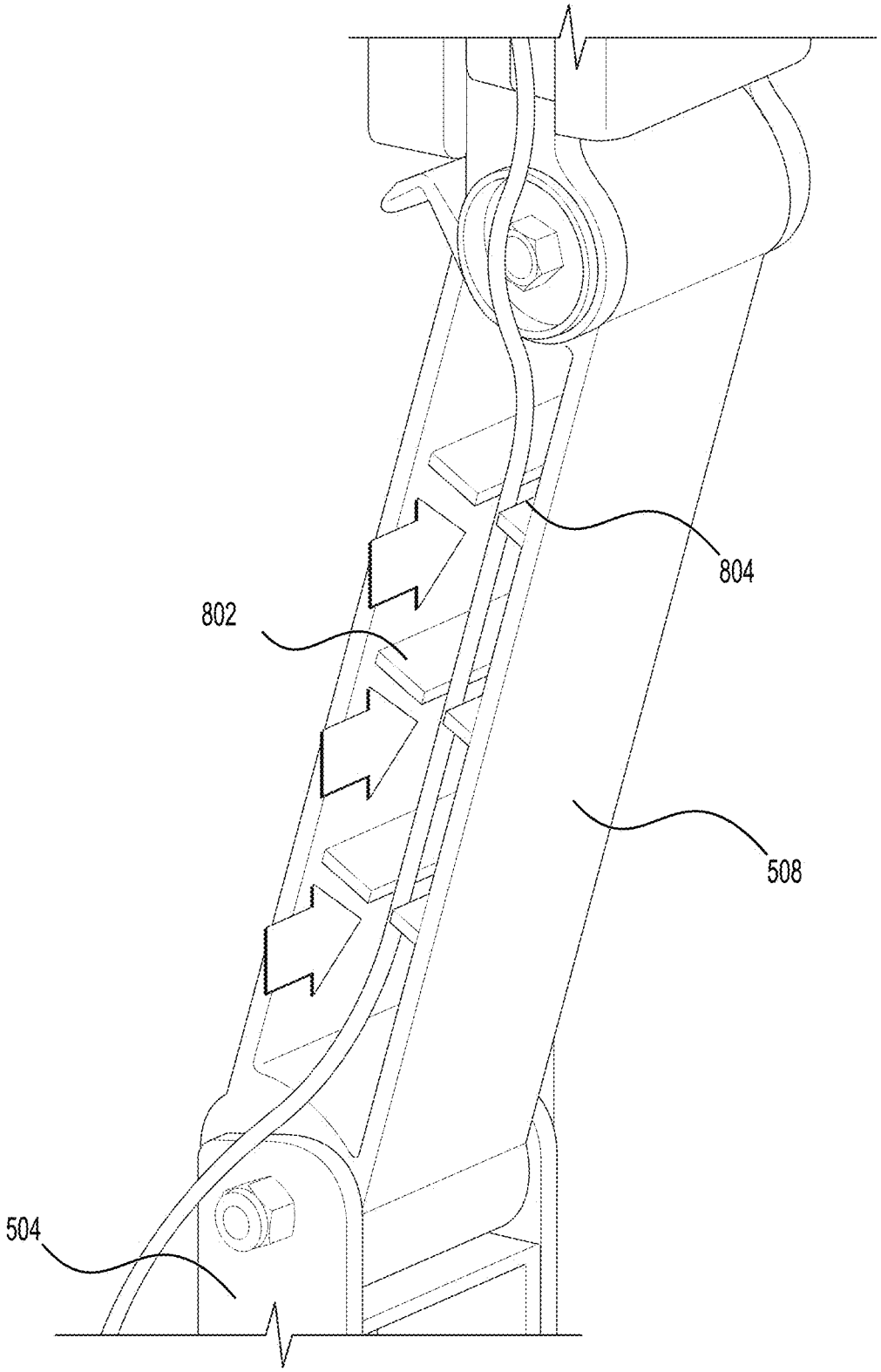
FIG. 8 depicts the routing of a cable through a PM5 mounting bracket.

The cables used to power and communicate with tablet 602 can be managed using cable management clips 114 as depicted in FIG. 7. In embodiments, the tablet 602 is coupled directly to the PM5 monitor 506 to receive its data output for display. In embodiments, an interior of PM5 monitor arm 508 may comprise one or more cable management extensions 802 having notches 804 as depicted in FIG. 8. The notches 804 can be used to secure the power cable or the data cable from the tablet 602. While specific embodiments of the invention have been described above, it will be appreciated that the invention may be practiced other than as described.

Figure 9:
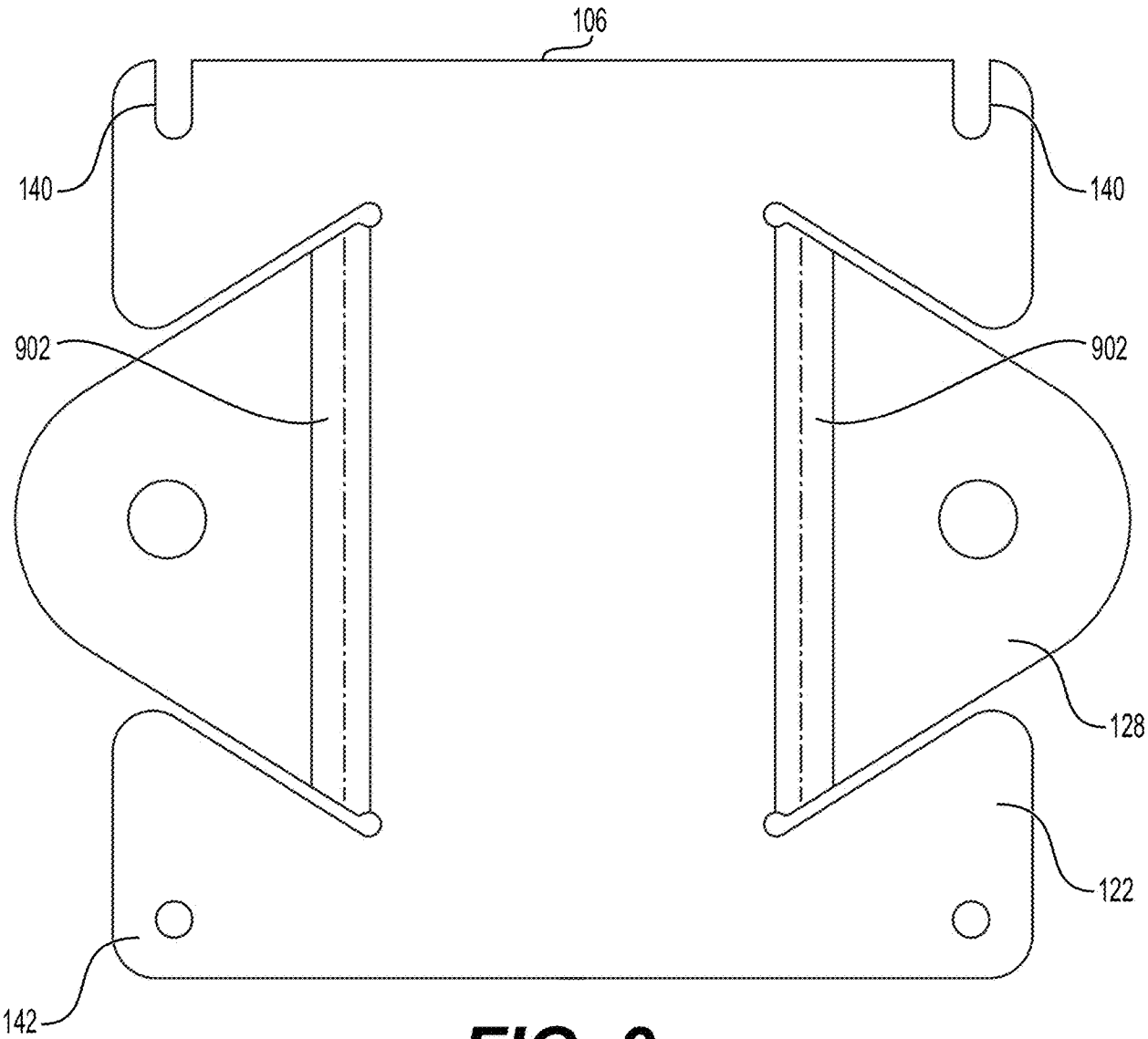
FIGS. 9-10 depict an alternate embodiment of the tablet mounting plate.
Figure 10:
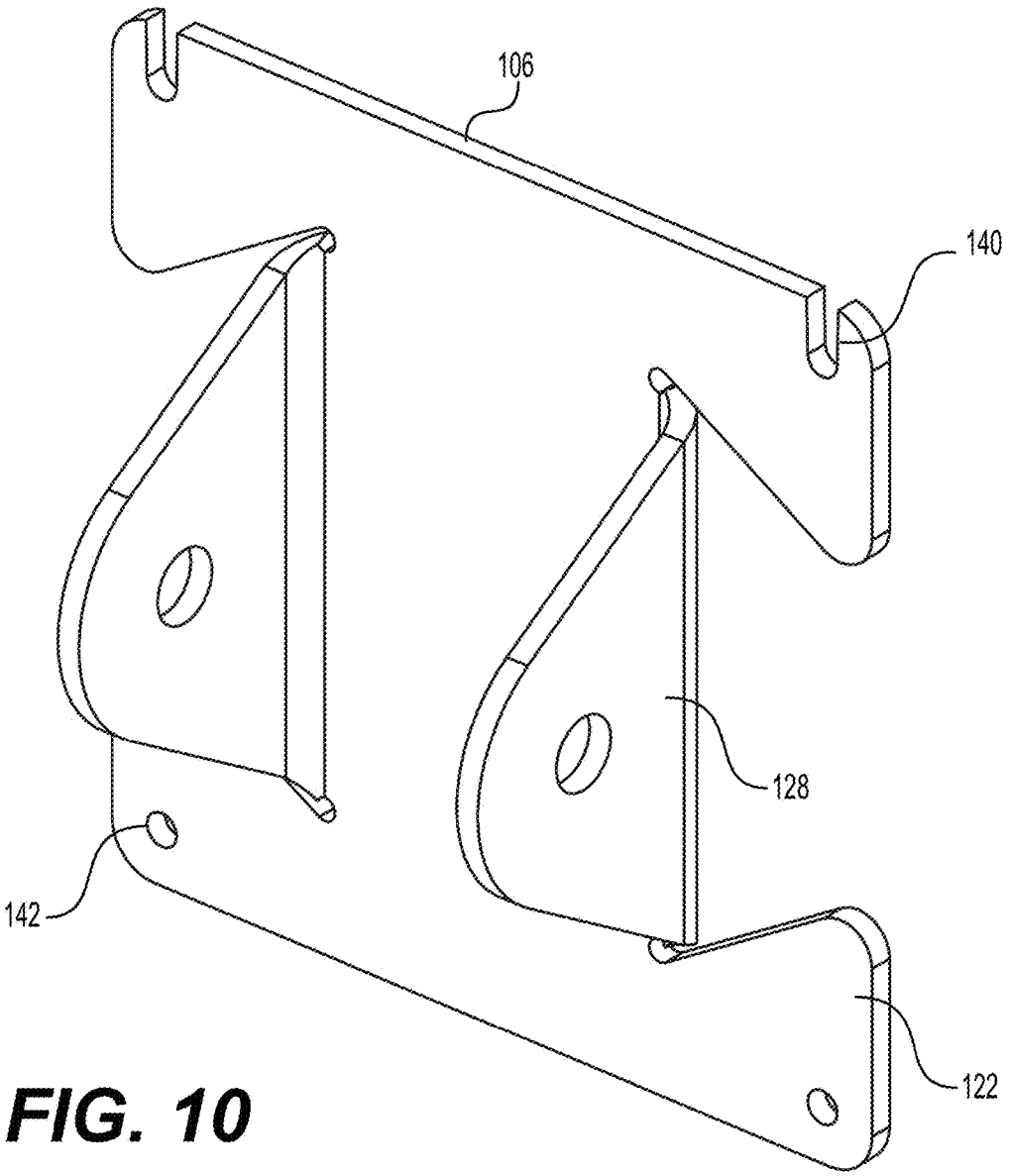

FIGS. 9-10 depict an alternate embodiment of tablet mounting plate 106. In this embodiment, mounting plate 122 has a smaller overall shape than depicted in FIGS. 1-5. The outer edges of mounting plate 122 are approximately the same size as a standard VESA mount while still supporting support tablets having a screen size ≥21.5". Mounting plate 122 comprises two slots 140 and openings 142 used for attaching tablet 602. The tablet mounting plate 106 of FIGS. 9-10 can be used in the same manner as depicted in FIGS. 6A-6E.

As depicted in FIG. 9, tablet mounting plate 106 can cut/formed by cutting a flat sheet of material (e.g., 1/8" steel) into the depicted shape and folding hinge extensions 128 about fold lines 902. The tablet mounting plate of FIGS. 1-5 can also be formed in a similar manner.

FIG. 6 depicts the steps used to couple a tablet 602 to mounting plate 122 after central tube 108 is coupled to bracket 504. As shown, the tablet 602 can be coupled directly to the tablet mounting system 100 via a plurality of screws (e.g., using the VESA standard). First, a shim 604 is used to screw in the upper two screws 606 into the VESA mounting openings on tablet 602 as depicted in FIG. 6A. Preferably, shim 605 has a thickness that is approximately the same as that of mounting plate 122 (e.g., 3/16"). Once the screws 606 have been inserted, the screws 606 can be slid into slots 140 as depicted in FIG. 6B-6C. This allows the tablet 602 to be simply slid into place, making installation easier. The screws 606 can then be tightened as needed in FIG. 6D. Finally, two lower screws 608 can be inserted through openings 142 and into the two remaining VESA mount openings on tablet 602 as depicted in FIG. 6E.

The embodiment(s) described, and references in the specification to "one embodiment," "an embodiment," "an example embodiment," "some embodiments," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The invention claimed is:

1. A table mounting system for an exercise device comprising:

a central tube;

a horizontal arm mounting bracket coupled to a top portion of the central tube;

a horizontal mounting arm coupled to the horizontal arm mounting bracket via a first pivot joint, wherein the horizontal mounting arm is orthogonal to the central tube, and wherein the horizontal mounting arm comprises a first hinge extension; and a tablet mounting plate comprising:

a second hinge extension extending from a rear of the tablet mounting plate; and a central hinge nested between ends of the second hinge extension, wherein the first hinge extension, the second hinge extension, and the central hinge are configured to permit the tablet mounting plate to pivot orthogonal to the horizontal mounting arm, wherein the exercise device comprises a mount coupled to a frame of the exercise device, and wherein the central tube comprises a first through hole near a bottom portion of the central tube for coupling the central tube to the frame.

2. The tablet mounting system according to claim 1, wherein the second hinge extension is nested between ends of the first hinge extension.

3. The tablet mounting system according to claim 2, wherein the central hinge comprises at least one disc spring.

4. The tablet mounting system according to claim 3, wherein a spring force of the at least one disc spring is adjustable by adjusting a tightness of a bolt and a nut securing the first hinge extension, the second hinge extension, and the central hinge together.

5. The tablet mounting system according to claim 1, wherein the central tube is hollow, and wherein the central tube comprises a removable cap for providing access to an interior of the central tube.

6. The tablet mounting system according to claim 5, wherein the central tube further comprises a plurality of cable management clips removably inserted into openings in the central tube.

7. The tablet mounting system according to claim 1, wherein the horizontal mounting arm comprises a horizontal tube, and wherein the first hinge extension is coupled to an exterior of the horizontal tube.

8. The tablet mounting system according to claim 1, wherein the tablet mounting plate is formed from a flat plate, and wherein the second hinge extension is formed by cutting two arcs in the flat sheet of material and folding the two arcs away from a front surface of the tablet mounting plate.

9. The tablet mounting system according to claim 8, wherein the tablet mounting plate comprises:

a first slot and a second slot formed in a top of the flat plate; and a first opening and a second opening in a lower portion of the flat plate.

10. The tablet mounting system according to claim 9, wherein a size of a rectangle formed having vertices at a bottom of the first slot, a bottom of the second slot, the first opening, and the second opening is a size of a VESA (Video Electronics Standards Association) bracket.

11. The tablet mounting system according to claim 9, further comprising:

a shim having a screw slot having a same width as the first slot, wherein a thickness of the shim is a same thickness as a thickness of the flat plate.

12. The tablet mounting system according to claim 11, wherein the shim is used to attach a first screw and a second screw to a rear of a tablet such that a head of the first screw and a head of the second screw extend from the rear of the tablet the thickness of the flat plate.

13. The tablet mounting system according to claim 12, wherein the tablet is removably coupled to the tablet mounting plate by concurrently sliding the first screw into the first slot and the second screw into the second slot.

14. The tablet mounting system according to claim 13, wherein a third screw placed through the first opening and a fourth screw placed through the second opening are used to secure the tablet to the tablet mounting plate.

15. The tablet mounting system according to claim 1, wherein the central tube is coupled to the bracket using a bolt placed through the bracket and the first through hole.

16. A table mounting system for an exercise device comprising:

a central tube;

a horizontal arm mounting bracket coupled to a top portion of the central tube;

a horizontal mounting arm coupled to the horizontal arm mounting bracket via a first pivot joint, wherein the horizontal mounting arm is orthogonal to the central tube, and wherein the horizontal mounting arm comprises a first hinge extension; and a tablet mounting plate comprising:

a second hinge extension extending from a rear of the tablet mounting plate; and a central hinge nested between ends of the second hinge extension, wherein the central tube is hollow, and wherein the central tube comprises a removable cap for providing access to an interior of the central tube.

17. A table mounting system for an exercise device comprising:

a central tube, a horizontal arm mounting bracket coupled to a top portion of the central tube;

a horizontal mounting arm coupled to the horizontal arm mounting bracket via a first joint, wherein the horizontal mounting arm is orthogonal to the central tube, and wherein the horizontal mounting arm comprises a first hinge extension; and a tablet mounting plate comprising:

a second hinge extension extending from a rear of the tablet mounting plate; and a central hinge nested between ends of the second hinge extension, wherein the tablet mounting plate is formed from a flat plate, and wherein the second hinge extension is formed by cutting two arcs in the flat sheet of material and folding the two arcs away from a front surface of the tablet mounting plate.

* * * * *